US005575892A

United States Patent [19]

Devore et al.

[11] Patent Number: 5,575,892

[45] Date of Patent: Nov. 19, 1996

[54] WET STRENGTH RESIN COMPOSITION

[75] Inventors: David I. Devore, Langhorne; Nancy Clungeon, Wyndmoor; Stephen A. Fischer, Yardley, all of Pa.

[73] Assignee: Henkel Corporation, Plymouth Meeting, Pa.

[21] Appl. No.: 461,345

[22] Filed: Jun. 5, 1995

Related U.S. Application Data

[62] Division of Ser. No. 270,088, Jul. 1, 1994, Pat. No. 5,503,713, which is a division of Ser. No. 142,642, Oct. 25, 1993, Pat. No. 5,350,796, which is a continuation of Ser. No. 695,198, May 3, 1991, abandoned.

[51] Int. Cl.[6] ..... D21H 11/00

[52] U.S. Cl. ..... 162/164.3; 162/163; 162/164.6; 162/168.2; 162/183

[58] Field of Search ..... 524/47, 514; 525/54.24, 525/178, 180, 183; 162/163, 164.3, 164.6, 168.2, 183

[56] References Cited

U.S. PATENT DOCUMENTS

| | | | |
|---|---|---|---|
| 3,058,873 | 10/1962 | Keim et al. | 162/164 |
| 4,017,431 | 4/1977 | Aldrich | 162/164 R |
| 4,218,286 | 8/1980 | Jones et al. | 162/164 R |
| 4,336,835 | 6/1982 | Takagishi et al. | 162/164.3 |
| 4,808,267 | 2/1989 | Kerkhoff et al. | 162/13 |
| 4,824,523 | 4/1989 | Wagberg et al. | 162/164.1 |
| 4,988,790 | 1/1991 | Behn et al. | 524/514 |
| 5,350,796 | 9/1994 | Devore et al. | 524/514 |

*Primary Examiner*—Judy M. Reddick
*Attorney, Agent, or Firm*—Ernest G. Szoke; Wayne C. Jaeschke; Real J. Grandmaison

[57] ABSTRACT

A composition for improving the wet strength of cellulosic fibrous webs is comprised of an aminopolyamide-epichlorohydrin acid salt resin having an E/N ratio of from about 0.6 to about 2.0 and from about 1% to about 35% of a water soluble cationic polymer based on the weight of the resin. The composition has a total organic chlorine content of from about 0.5% to 1.0% by weight based on the weight of the aminopclyamide-epichlorohydrin acid salt resin.

7 Claims, No Drawings

WET STRENGTH RESIN COMPOSITION

This application is a division of U.S. Ser. No. 08/270,088, filed Jul. 01, 1994, now U.S. Pat. No. 5,503,713, which is a division of U.S. Ser. No. 08/142,642, filed Oct. 25, 1993, now U.S. Pat. No. 5,350,796, which is a continuation of U.S. Ser. No. 07/695,198, filed May 03, 1991, now abandoned.

BACKGROUND OF THE INVENTION

1. Field of the Invention

This invention relates to wet strength resin compositions and methods of using them to produce cellulosic pulp fiber webs having increased wet strength.

2. Description of the Related Art

Polyamine-epichlorohydrin resins have been used as wet strength resins for paper since the early 1950's. These resins are cationic by virtue of the fact that they contain quaternary ammonium functionalities and are, therefore, substantive to negatively charged cellulose pulp fibers. These resins are particularly useful because they are formaldehyde-free and develop wet strength at neutral or alkaline pH values. One of the drawbacks associated with the use of a aminopolyamide-epichlorohydrin wet strength resins is the emission of harmful chlorinated compounds into the water systems of pulp and paper mills. These chlorinated compounds, which are the by-products of the manufacture of the aminopolyamide-epichlorohydrin resins, have been identified as epichlorohydrin, 1,3-dichloro-2-propanol, and 3-chloro-1,2-propanediol. A large percentage of these chlorinated organics, the total weight of any one or a combination of all of which is defined as the TOCl, are usually discharged into the air and water effluent from pulp and paper mills. Since permissible amounts of halogenated organics in waste waters is ever decreasing, considerable effort has been expended to reduce the amount of these materials in aminopolyamide-epichlorohydrin wet strength resins. Copending patent application Ser. No. 07/573,600, filed on Aug. 24, 1990 provides a wet strength resin composition comprising from about 1% to about 60% by weight of a aminopolyamide-epichlorohydrin acid salt resin, up to about 0.3% by weight total organic chlorine or TOCl based on the weight of said resin, and the remainder water. The aminopolyamide-epichlorohydrin acid salt resin in the wet strength resin has an E/N ratio of from about 0.6 to about 1.2. Prior to the present invention, it had been observed that compositions containing aminopolyamide-epichlorohydrin resins having TOCl values in the 0.5 to 1.2 % range did not increase wet tensile to the same degree as existing commercially available products which had E/N ratios≧1.5. However, resins having E/N ratios≧1.5 also had TOCl values which are too high for the lower contemporary TOCl standards.

It is well known in the art to use retention aids or floculating agents to precipitate wet strength resins which by themselves are not substantive to pulp onto the surface of cellulosic pulp fibers when the wet strength resins are added at some point in the wet end of a paper machine during the paper making process. Some examples of wet strength resins that are not self retaining are neutral urea-formaldehyde resins, aldehyde-modified resins and dialdehyde starch dispersions. In each case, the cationic polymer serves to attract the wet strength resins by opposing electrostatic forces or by reducing the anoinic repulsive forces of cellulose fibers. Paper maker's alum is the simplest and perhaps the oldest material that has been used as a retention aid or flocculating agent. Most retention aids are positively charged materials which facilitate absorption onto the negatively charged surface of the cellulosic pulp fibers. Polymers having cationic charges are commonly used as retention aids. Examples include cationic urea-formaldehyde resins, cationic melamine-formaldehyde resins, cationic polyamine resins, cationic polyethyleneimine resins, cationic starch, polydiallyldimethylammonium chloride (polyDADMAC).

DE 3506832 teaches that paper having high dry strength and low wet strength is prepared by successive addition of water soluble cationic polymers and anionic polymers. The cationic polymers include the reaction product of an adipic acid-diethylenetriamine copolymer and epichlorohydrin, polyethyleneimine, and polydiallyldimethylammonium chloride (polyDADMAC). Anionic polymers include acrylamide-acrylic acid-acrylonitrile copolymers and acrylic acid-acrylonitrile copolymers. Nordic Pulp Paper Research J., 2, 49–55 (1987) teaches the rapid flocculation of Kraft fibers with dual-component retention aid systems comprised of, for example, polydiallyldimethylammonium chloride and polyacrylamide. U.S. Pat. No. 4,824,523 teaches a method for manufacturing paper comprising the step of adding a dry strength retention agent system to paper stock prior to forming paper wherein the system is comprised of cationic starch, an anionic polymer, non-starch cationic synthetic polymer, a cationic amido-amine-epichlorohydrin polymer, and a reaction product formed between epichlorohydrin or polyepichlorohydrin and ammonia. U.S. Pat. No. 4,754,021 teaches a method of enhancing the dewatering of paper during the papermaking process which includes adding a low molecular weight cationic organic polymer selected from polydiallyldimethylammonium chloride, and epichlorohydrin-dimethylamine copolymer. Canadian patent number 1,110,019 teaches a process for manufacturing paper having improved dry strength which comprises mixing an essentially alum free pulp slurry with a water soluble cationic polymer and subsequently adding a water soluble anionic polymer to the essentially alum free slurry and then adding alum. The water soluble cationic polymer can be the reaction product of epichlorohydrin and a polyamide-polyamine.

It is not known in the art to add cationic polymers or cationic polymers that do not yield wet strength properties into the wet end of a paper machine along with a self-retaining cationic wet strength resin such as a aminopolyamide-epichlorohydrin acid resin salt. The skilled artisan would seek to avoid the simultaneous use of two polymers having cationic charges because they would compete for adsorption onto the surface of the negatively charged cellulose fibers. Such a competitive adsorption situation would be expected to result in a lower than anticipated wet tensile increase. It is also not known in the art to resolve the low TOCl-low wet tensile building performance trade-off by employing a water soluble cationic polymer with a aminopolyamide-epichlorohydrin acid salt resin. The cationic polymer and aminopolyamide-epichlorohydrin acid salt resin can be combined into a composition and used to treat a pulp fiber slurry or the cationic polymer and aminopolyamide-epichlorohydrin wet strength resin can be added sequentially to the pulp fiber slurry.

SUMMARY OF THE INVENTION

Other than in the operating examples, or where otherwise indicated, all numbers expressing quantities of ingredients or reaction conditions used herein are to be understood as modified in all instances by the term "about".

It has been found that an increase in the wet strength of a cellulosic pulp fiber web can be achieved by adding a composition comprised of an aminopolyamide-epichlorohydrin acid salt resin having an E/N ratio of from about 0.6 to about 2.0 and from about 1% to about 35% by weight of the resin of a water soluble cationic polymer to an aqueous slurry of the cellulsoic pulp fibers. The composition according to the invention has a TOCl value of from about 0.05% to 6.5% by weight. The unexpected increase in the wet strength is achieved in spite of the simultaneous use of two positively charged polymers to the cellulose fibers one of which is an aminopolyamide-epichlorohydrin acid salt resin having an E/N ratio of from about 0.6 to about 2.0.

DESCRIPTION OF THE PREFERRED EMBODIMENTS

One aspect of the present invention provides a composition useful as a wet strength resin which is comprised of an aminopolyamide-epichlorohydrin acid salt resin having an E/N ratio of from about 0.6 to about 2.0 and from about 1% to about 35% by weight of said resin of a water soluble cationic polymer. The aminopolyamide-epichlorohydrin acid salt resin according to the invention can be made by reacting a aminopolyamide resin with epichlorohydrin over an extended period of time. Aminopolyamide resins are well known to those of ordinary skill in the art and can be made by reacting a dicarboxylic acid such as adipic acid with a polyamine which is a compound having at least two amine functionalities such as a simple diamine as ethylene diamine or more than two amine functionalities such as diethylenetriamine, triethylenetetramine, tetraethylenepentamine, and bis-hexamethylenetriamine and the like. An aminopolyamide can also be made by reacting a dicarboxylic acid ester such as dimethyl adipate with a polyamine. While any water soluble, water-miscible, or water-dispersable aminopolyamide can be used in the composition according to the invention, aminopolyamide resins wherein the dicarboxlyic acid component contains from 4 to 6 carbon atoms and the diamine component contains at least three amine functionalities are preferred. The most preferred aminopolyamide resins are those made by reacting adipic acid with diethylenetriamine, glutaric acid with diethylenetriamine, adipic acid with triethylenetetramine, glutaric acid with triethylenetetramine, or combinations of adipic, glutaric, and succinic acids with diethylenetriamine, or triethylenetetramine or combinations of diethylenetriamine and triethylenetetramine or any combination of all of the above. A aminopolyamide-epichlorohydrin acid salt resin can be made by dissolving a aminopolyamide resin in water to form a solution followed by reaction with epichlorohydrin. The pH of the solution is then adjusted to a value of up to about 7.0 by acidifying it with an acid, preferably an aqueous acid solution such as hydrochloric acid.

The aminopolyamide-epichlorohydrin polymers according to the invention are prepared so that they have an E/N ratio of from about 0.6 to about 2.0. The E/N ratio is defined by Equation I as $$\frac{\text{moles epichlorohydrin}}{\text{amine equivalents}} \qquad \text{Eq. I}$$

where the amine equivalents is defined by Equation II as $$\frac{\text{wt. of aminopolyamide sol'n} \times \text{\% solids as decimal} \times TA}{56110} \qquad \text{Eq. II}$$

and TA, which is total alkalinity, is defined by Equation III as $$\frac{\text{volume (ml)} \times \text{normality of } \textit{stnd.} \text{ acid} \times 56.11}{\text{wt. of aminpolyamide sol'n} \times \text{\% solids as decimal}} \qquad \text{Eq. III}$$

The total alkalinity of a typical aminopolyamide is in the range of from about 270 to about 280 mg/g of KOH on a solids basis. In cases where it is desired to maintain the TOCl level in the final wet strength resin composition equal to or less than about 0.6%, the E/N ratio should be maintained in the range of 0.6 to 1.0.

A typical aminopolyamide-epichlorohydrin polymer according to the invention having the appropriate E/N ratio can be prepared by adding an amount of epichlorohydrin sufficient to achieve an E/N ratio of from about 0.6 to about 2.0. This amount can be calculated by substituting the numerical value for the amine equivalents as calculated by Equation II into Equation I, setting the E/N value equal to the desired E/N ratio, and solving the equation for moles of epichlorohydrin. The epichlorohydrin is added to the aminopolyamide solution neat over a period of from about 60 to about 180 minutes and at a temperature in the range of from about 10° C. to about 15° C. The temperature of the reaction mixture is then maintained in a range of from about 15° C. to about 35° C. until all of the epichlorohydrin has reacted. A detailed preparation of a typical aminopolyamide-epichlorohydrin polymer is given in Example 2.

The other principal component of the wet strength resin composition according to the invention is a water soluble cationic polymer. A water soluble cationic polymer is any water soluble polymer having one or more positive charges such as homo- and copolymers of ethyleneimine, dimethyldiallylammonium chloride, acryloyloxyethyltrimethylammonium chloride, methacryloyloxyethyltrimethylammonium chloride, diemthylaminoethylmethacrylate, acrylamide, cationic starch, and the like. Many of these cationic polymers are commercially available. For example, commercially available polyacrylamides include but are not limited to Separan™ (Dow Chemical Co.), Accurac™ (Amercian Cyanamide), and Reten-205™ (Hercules). Commercially available polyamine-based cationic polymers include but are not limited to Lufax 295™ (Rohm & Haas), Polymer X-150™ (Union Carbide), and Reten-703™ (Hercules). While alum or any water soluble cationic polymer can be used in the composition according to the invention, polydimethyldiallylammonium chloride, poly-DADMAC, is most preferred. Overall, the preferred composition according to the invention is comprised of a aminopolyamide-epichlorohydrin acid salt resin having an E/N ratio of from about 0.6 to about 1.0, and from about 1% to about 35% by weight of poly-DADMAC based on the weight of the aminopolyamide-epichlorohydrin acid salt resin. The most preferred composition is comprised of a aminopolyamide-epichlorohydrin acid salt resin having an E/N ratio of about 1.0, and about 10% by weight of poly-DADMAC based on the weight of the aminopolyamide-epichlorohydrin acid salt resin.

An aqueous composition comprising water and from about 1% to about 60% by weight of a aminopolyamide-epichlorohydrin acid salt resin having an E/N ratio of from about 0.6 to about 2.0; and from about 1% to about 35% by weight of a water soluble cationic polymer based on the weight of said resin is also a preferred embodiment of the composition according to the invention. One particularly preferred aqueous composition according to the invention is comprised of water and from about 1% to about 60% by weight of a aminopolyamide-epichlorohydrin acid salt resin having an E/N ratio of from about 0.6 to about 2.0; and from about 5% to about 15% by weight of polydimethyldiallylammonium chloride based on the weight of said resin. Another particularly preferred aqueous composition according to the invention is comprised of water and from about 10% to about 45% by weight of a aminopolyamide-epichlorohydrin acid salt resin having an E/N ratio of from about 0.6 to about 2.0; and from about 5% to about 15% by weight of polydimethyldiallylammonium chloride based on the weight of said resin.

The compositions according to the invention can be made by any means known to those skilled in the art including mixing aqueous solutions of a aminopolyamide-epichlorohydrin polymer and a cationic polymer or dissolving the solid cationic polymer in an aqueous aminopolyamide-epichlorohydrin polymer solution. While the amounts of aminopolyamide-epichlorohydrin polymer and cationic polymer can be present in any proportion, it is preferred that the composition contain from about 5% to about 15% by weight of cationic polymer based on the total weight of aminopolyamide-epichlorohydrin polymer and cationic polymer. A wet strength resin composition according to the invention can be applied at dosage levels from about 1 to about 30 lbs/ton of dry fiber based on the weight of the aminopolyamide-epichlorohydrin acid resin salt, preferably from about 6 to about 15 lbs/ton and most preferably at 8 lbs/ton.

One process for making a cellulosic pulp fiber web having increased wet strength according to the invention comprises adding a aminopolyamide-epichlorohydrin polymer-cationic polymer composition to an aqueous cellulosic pulp fiber slurry followed by formation of a cellulosic pulp fiber web by dewatering the treated slurry in the normal paper making process. The aminopolyamide-epichlorohydrin polymer-cationic polymer composition can be applied at any point in the wet end of the papermaking process. Equal results are obtainable if the composition is added for example, to the stock chest, the head box, or at the fan pump.

Another process for making a cellulosic pulp fiber web having increased wet strength according to the invention comprises adding each component of the composition according to the invention separately. This process includes adding a cationic polymer according to the invention to an aqueous cellulosic pulp fiber slurry followed by the addition of an amount a aminopolyamide-epichlorohydrin acid salt resin having an E/N ratio of from about 0.6 to about 2.0; and (3) forming a cellulosic pulp fiber web by dewatering said second treated slurry. The amount of cationic polymer added in this manner is chosen so that from about 5% to about 15% by weight of cationic polymer is added based on the weight of aminopolyamide-epichlorohydrin polymer. The two components added in this process can be added at any point in the wet end of the papermaking process. Both may be added at the same point or at different points in the papermaking process. The points of addition are not important as long as both components are present in the aqueous cellulosic pulp fiber slurry before the fibers are dewatered to form a sheet.

The process in which the aminopolyamide-epichlorohydrin polymer and cationic polymer composition are added sequentially is the preferred method of making a cellulosic pulp fiber web having increased wet strength. The following examples are meant to illustrate but not limit the invention.

Cellulosic fibrous webs treated with the compositions according to the invention are comprised of cellulose pulp fibers and from about 1 to about 30 lbs/ton of the cellulose pulp fibers of an aminopolyamide-epichlorohydrin acid salt resin having an E/N ratio of from about 0.6 to about 2.0 and from about 1% to about 35% by weight of the resin of a water soluble cationic polymer.

EXAMPLE 1

Preparation of a Aminopolyamide Resin

To a resin reactor was charged 269 grams of dibasic acid ester mixture comprised of 65% dimethyl glutarate and 35% dimethyl adipate and 170 grams of diethylene triamine. Stirring and nitrogen sparge were started and the contents of the reactor were heated to 150° C. This temperature was maintained until the start of methanol reflux. The reflux was allowed to continue until the reaction temperature reached 85° C. at which time the methanol was distilled off. The reaction temperature rose to 150° C. during the distillation which afforded 109 grams of methanol. A 32.9% solids aminopolyamide resin solution was made by dissolving the reaction product in 670 grams of water. The total alkalinity was determined to be 274.8 mg KOH/g on a solids basis.

EXAMPLE 2

Preparation of Aminopolyamide-Epichlorohydrin Polymer

To a round bottom flask were charged 171 grams of a 48.0% solids aminopolyamide resin solution having a total alkalinity based on solids content (TA) of 274.8 mg KOH/g and 38 grams of water. Gentle stirring was applied and the contents of the flask were cooled to about 15° C. (ECH addition temperature) at which time about 26 grams of epichlorohydrin were added over 3 hours. After completion of the epichlorohydrin addition, the contents of the reactor were allowed to exotherm to a temperature of about 20° C. The reaction mass was held at this temperature for 12.5 hours (ECH reaction temperature & time). The viscosity at this point (Final Visc.) was 602 cps. The reaction was stopped by adjusting the pH of the solution to 2.0 with 37% hydrochloric acid.

EXAMPLE 3

Aminopolyamide-Epichlorohydrin resins A through F in the following table were made according to the method of Example 2.

TABLE 1

| | Wet Strength Resin Compositions | |
|---|---|---|
| Sample I.D. | E/N Ratio[1] | Composition |
| S[6] | 1.5 | APE resin[2] – no C.P.[3] |
| A | 1.0 | APE resin – no C.P. |
| B | 1.0 | APE resin + 10% pDADMAC[4] |
| C | 1.0 | APE resin + 5% pDADMAC[4] |
| D | 1.0 | APE resin + 10% pDADMAC[5] |
| E | 0.7 | APE resin – no C.P. |
| F | 0.7 | APE resin + 10% pDADMAC[5] |

[1]E/N ratio of APE resin
[2]APE resin - aminopolyamide-epichlorohydrin
[3]C.P.- cationic polymer; % is wt % based on wt of APE resin
[4]intrinsic viscosity of pDADMAC is 0.5 dl/g
[5]intrinsic viscosity of pDADMAC is 0.3 dl/g
[6]a commercial APE resin.

EXAMPLE 4

Performance Testing of Wet Strength Resin Compositions

1. Stock Preparation

Commercial stock of about 0.3% was diluted to 0.2% consistency. The drainage of the stock was measured at 110–120 ml by "30 Second Britt Drainage" method using a 8" circular 70 mesh screen with the Mark IV Dynamic Handsheet Mold/Paper Chemistry Jar Assembly.

2. Handsheet Preparation

Blank handsheets were prepared according to the handsheet preparation method outlined in the Mark IV Dynamic Handsheet Mold/Paper Chemistry Jar Assembly operating manual. Treated handsheets were prepared by the same method except that the wet strength resin composition according to the invention was added at a dosage of 8 dry pounds of ton of aminopolyamide-epichlorohydrin resin per ton of dry pulp to the dispersed stock slurry and the furnish was mixed at 750 r.p.m. for 55 seconds. Handsheets were blotted dry between felt sheets and pressed with a rolling pin in back and forth and diagonal directions. Pressed sheets were dried and cured according to the schedule listed below.

3. Furnish Compositions

A. Furnish #1—Mixed Softwood Kraft Fines Content—17% Handsheet Cure Schedule
   a. 10 min. dry @105° C.
   b. 10 min. cure @105° C.
   c. 24 hr. equilibration at 50% R.H. @25° C.

B. Furnish #2—Mixed Hardwood-Softwood Kraft Fines Content —15% Handsheet Cure Schedule
   a. 10 min. dry @105° C.
   b. 10 min. cure @105° C.
   c. 24 hr. equilibration at 50% R. H. @25° C.

C. Furnish #2—Mixed Hardwood-Softwood Kraft Fines Content—15% Handsheet Cure Schedule
   Dried and cured at 70° C. at 50% R.H.

4. Wet Tensile Determination

Tensile strips measuring 1" by 4" were cut from treated handsheets and soaked for 1 hour in water at 25° C. Tensile strengths were determined on an Instron Tensile Tester using a 10 lb load cell.

EXAMPLE 5

Performance of Wet Strength Resin Compositions

The wet strength resin compositions listed in Table 1 of Example 3 above were tested on furnishes #1 and #2. The physical properties cellulosic pulp fiber sheets treated with the compositions according to the invention are given in Table 2. The performance of each wet strength resin composition is expressed as % wet/dry which is the wet tensile/dry tensile + 100%. The application rate of wet strength/ton of dry fiber was 8.0 lbs/ton in all cases. Each set of tensile strength determinations was performed using a commercially available APE resin as a control and are separated by a horizontal line. Sequential addition means that the poly-DADMAC was added to the aqueous fiber slurry first followed by the APE resin.

TABLE 2

| Sample I.D. | Furnish # | % Wet/Dry | Set # |
|---|---|---|---|
| A | 1 | 14.2 | |
| B | 1 | 18.2 | 1 |
| C | 1 | 16.8 | |
| S | 1 | 18.1 | |
| A | 2 | 12.1 | |
| B(seq. add'n) | 2 | 17.5 | 2 |
| S | 2 | 16.7 | |
| D | 2 | 18.4 | 3 |
| F | 2 | 14.4 | |
| S | 2 | 16.4 | |

TABLE 2-continued

| Sample I.D. | Furnish # | % Wet/Dry | Set # |
|---|---|---|---|
| A | 2 | 11.8 | |
| B | 2 | 14.8 | 4 |
| S | 2 | 15.4 | |
| E | 3 | 13.2 | |
| F | 3 | 15.8 | 5 |
| S | 3 | 17.8 | |

The data in Table 2 show the effect of the incorporation of a cationic polymer such as poly-DADMAC into a wet strength resin composition which contains a APE resin on the wet tensile building efficiency of the wet strength composition. Set 1 shows that by incorporating 10% poly-DADMAC the % wet/dry of a sheet made from furnish #1 and treated with a composition containing a APE resin having an E/N ratio equal to 1.0 is equally as effective as the commercially available resin which has an E/N ratio > about 1.2. Set 2 shows the same thing as set 1 except that the sheet is made from furnish #2. The data in set 2 also shows the improvement in the % wet/dry resulting from the sequential addition of poly-DADMAC followed by the APE resin. Set 3 shows the effect of using lower molecular weight poly-DADMAC in combination with APE resins in a sheet made from furnish #2. Set 4 shows the same thing as set 1 using a different furnish. Set 5 shows the wet strength improvement by incorporating 10% p-DADMAC with a APE resin having an E/N ratio equal to 0.7. Overall, the data in Table 2 show that compositions according to the invention overcome the tradeoff of less than acceptable wet tensile increase for low TOCl.

What is claimed is:

1. A cellulosic fibrous web comprising cellulose pulp fibers containing from about 1 to about 30 lbs/ton of said cellulose pulp fibers of an aminopolyamide-epichlorohydrin acid salt resin having an E/N ratio of from about 0.6 to about 2.0 and from about 1% to about 35% by weight of said resin of a water soluble cationic polymer consisting of poly-dimethldilyammonium chloride.

2. The cellulosic fibrous web of claim 1 wherein the amount of said aminopolyamide-epichlorohydrin acid salt resin is from about 6 to about 15 lbs/ton of said cellulose pulp fibers.

3. The cellulosic fibrous web of claim 2 wherein the amount of said aminopolyamide-epichlorohydrin acid salt resin is about 8 lbs/ton of said cellulose pulp fibers.

4. The cellulosic fibrous web of claim 1 wherein said E/N ratio is from about 0.6 to about 1.0.

5. The cellulosic fibrous web of claim 4 wherein said E/N ratio is about 1.0.

6. The cellulosic fibrous web of claim 1 wherein the amount of said cationic polymer is from 5% to about 15% by weight based on the weight of said resin.

7. The cellulosic fibrous web of claim 6 wherein the amount of said cationic polymer is about 10% by weight based on the weight of said resin.

* * * * *